US008339249B2

(12) United States Patent
Kitazoe

(10) Patent No.: US 8,339,249 B2
(45) Date of Patent: Dec. 25, 2012

(54) PAGING AND NOTIFICATION MECHANISM FOR EMERGENCY WARNING SYSTEM OVER CELLULAR NETWORKS

(75) Inventor: Masato Kitazoe, Hachiouji (JP)

(73) Assignee: QUALCOMM Incorporated, San Diego, CA (US)

( * ) Notice: Subject to any disclaimer, the term of this patent is extended or adjusted under 35 U.S.C. 154(b) by 610 days.

(21) Appl. No.: 12/512,005

(22) Filed: Jul. 29, 2009

(65) Prior Publication Data

US 2010/0026472 A1 Feb. 4, 2010

Related U.S. Application Data

(60) Provisional application No. 61/085,945, filed on Aug. 4, 2008.

(51) Int. Cl.
*G08B 3/00* (2006.01)
*H04R 27/00* (2006.01)

(52) U.S. Cl. ..... 340/311.2; 455/404.1; 455/458

(58) Field of Classification Search ..... 340/311.2; 455/404.1, 434, 445, 458
See application file for complete search history.

(56) References Cited

U.S. PATENT DOCUMENTS

| | | | | |
|---|---|---|---|---|
| 2003/0157923 | A1* | 8/2003 | Tani | 455/404 |
| 2006/0281456 | A1* | 12/2006 | Roberts et al. | 455/434 |
| 2009/0239554 | A1* | 9/2009 | Sammour et al. | 455/458 |
| 2011/0059718 | A1* | 3/2011 | Wang et al. | 455/404.1 |
| 2011/0086608 | A1* | 4/2011 | Yamagishi et al. | 455/404.1 |

* cited by examiner

*Primary Examiner* — John A Tweel, Jr.
(74) *Attorney, Agent, or Firm* — John J. Ketchum

(57) ABSTRACT

Certain aspects of the present disclosure provide a method for transmitting emergency warning messages over cellular networks. In the proposed method, the access point transmits scheduling information of the emergency information in addition to the non-emergency information in a first system information block (SIB1) to a plurality of user equipments. In case of an emergency, the access point notifies the user equipments of the emergency situation and transmits emergency information to the user equipments to provide more information about the emergency situation. Since the user equipments already have scheduling information of the emergency information, they can start receiving the emergency information immediately after the emergency notification.

24 Claims, 5 Drawing Sheets

PAGING AND NOTIFICATION MECHANISM FOR EMERGENCY WARNING SYSTEM OVER CELLULAR NETWORKS

RELATED APPLICATIONS

This application claims benefit of U.S. Provisional Patent Application Ser. No. 61/085,945 filed Aug. 4, 2008, and assigned to the assignee hereof and hereby expressly incorporated by reference herein.

BACKGROUND

1. Field

Certain aspects of the present disclosure generally relate to wireless communication and, more particularly, to a technique for notification of emergency warnings over cellular networks.

2. Background

Wireless communication systems are widely deployed to provide various types of communication content such as voice, data, and so on. These systems may be multiple-access systems capable of supporting communication with multiple users by sharing the available system resources (e.g., bandwidth and transmit power). Examples of such multiple-access systems include code division multiple access (CDMA) systems, time division multiple access (TDMA) systems, frequency division multiple access (FDMA) systems, 3GPP Long Term Evolution (LTE) systems, and orthogonal frequency division multiple access (OFDMA) systems.

Generally, a wireless multiple-access communication system can simultaneously support communication for multiple wireless terminals. Each terminal communicates with one or more base stations via transmissions on the forward and reverse links. The forward link (or downlink) refers to the communication link from the base stations to the terminals, and the reverse link (or uplink) refers to the communication link from the terminals to the base stations. This communication link may be established via a single-in-single-out, multiple-in-single-out or a multiple-in-multiple-out (MIMO) system.

In some wireless standards such as LTE, an Earthquake and Tsunami Warning System (ETWS) is developed. In LTE standard, the warning notification is delivered over the system information broadcast message. However, the normal system information block (SIB) transmission and its modifications are restricted by a 'modification period.' For urgent emergency warning messages, the system should not waste any time and the modification period may be too long depending on the nature of the emergency situation.

Therefore, there is a need in the art for an emergency warning scheme that is not restricted by a modification period. The emergency information should be transmitted to all the user equipments as soon as the emergency situation happens.

SUMMARY

Certain aspects provide a method for wireless communications by an access point. The method generally includes transmitting scheduling information in a first system information block (SIB1) to a plurality of user equipments, wherein the SIB1 includes scheduling information of emergency information and non-emergency information, notifying the user equipments of an emergency situation, and transmitting emergency information to the user equipments to provide more information about the emergency situation.

Certain aspects provide a method for wireless communications by a user equipment. The method generally includes receiving scheduling information in a first system information block (SIB1) from an access point, wherein the SIB1 includes scheduling information of emergency information and non-emergency information, receiving a notification of an emergency situation, overriding the scheduling of non-emergency information with emergency information, and receiving emergency information from the access point after the notification of the emergency situation.

Certain aspects provide an apparatus for wireless communications by an access point. The apparatus generally includes logic for transmitting scheduling information in a first system information block (SIB1) to a plurality of user equipments, wherein the SIB1 includes scheduling information of emergency information and non-emergency information, logic for notifying the user equipments of an emergency situation, and logic for transmitting emergency information to the user equipments to provide more information about the emergency situation.

Certain aspects provide an apparatus for wireless communications by a user equipment. The apparatus generally includes logic for receiving scheduling information in a first system information block (SIB1) from an access point, wherein the SIB1 includes scheduling information of emergency information and non-emergency information, logic for receiving a notification of an emergency situation, logic for overriding the scheduling of non-emergency information with emergency information, and logic for receiving emergency information from the access point after the notification of the emergency situation.

Certain aspects provide an apparatus for wireless communications by an access point. The apparatus generally includes means for transmitting scheduling information in a first system information block (SIB1) to a plurality of user equipments, wherein the SIB1 includes scheduling information of emergency information and non-emergency information, means for notifying the user equipments of an emergency situation, and means for transmitting emergency information to the user equipments to provide more information about the emergency situation.

Certain aspects provide an apparatus for wireless communications by a user equipment. The apparatus generally includes means for receiving scheduling information in a first system information block (SIB1) from an access point, wherein the SIB1 includes scheduling information of emergency information and non-emergency information, means for receiving a notification of an emergency situation, means for overriding the scheduling of non-emergency information with emergency information, and means for receiving emergency information from the access point after the notification of the emergency situation.

Certain aspects provide a computer-program product for wireless communications by an access point, comprising a computer-readable medium having instructions stored thereon, the instructions being executable by one or more processors. The instructions generally include instructions for transmitting scheduling information in a first system information block (SIB1) to a plurality of user equipments, wherein the SIB1 includes scheduling information of emergency information and non-emergency information, instructions for notifying the user equipments of an emergency situation, and instructions for transmitting emergency information to the user equipments to provide more information about the emergency situation.

Certain aspects provide a computer-program product for wireless communications by a user equipment, comprising a computer-readable medium having instructions stored thereon, the instructions being executable by one or more processors. The instructions generally include instructions for receiving scheduling information in a first system information block (SIB1) from an access point, wherein the SIB1 includes scheduling information of emergency information and non-emergency information, instructions for receiving a notification of an emergency situation, instructions for overriding the scheduling of non-emergency information with emergency information, and instructions for receiving emergency information from the access point after the notification of the emergency situation.

Certain aspects provide an apparatus for wireless communications by an access point. The apparatus generally includes at least one processor configured to transmit scheduling information in a first system information block (SIB1) to a plurality of user equipments, wherein the SIB1 includes scheduling information of emergency information and non-emergency information, notify the user equipments of an emergency situation, and transmit emergency information to the user equipments to provide more information about the emergency situation, and a memory coupled to the processor.

Certain aspects provide an apparatus for wireless communications by a user equipment. The apparatus generally includes at least one processor configured to receive scheduling information in a first system information block (SIB1) from an access point, wherein the SIB1 includes scheduling information of emergency information and non-emergency information, receive a notification of an emergency situation, override the scheduling of non-emergency information with emergency information, and receive emergency information from the access point after the notification of the emergency situation, and a memory coupled to the processor.

BRIEF DESCRIPTION OF THE DRAWINGS

So that the manner in which the above-recited features of the present disclosure can be understood in detail, a more particular description, briefly summarized above, may be had by reference to aspects, some of which are illustrated in the appended drawings. It is to be noted, however, that the appended drawings illustrate only certain typical aspects of this disclosure and are therefore not to be considered limiting of its scope, for the description may admit to other equally effective aspects.

DETAILED DESCRIPTION

The techniques described herein may be used for various wireless communication networks such as Code Division Multiple Access (CDMA) networks, Time Division Multiple Access (TDMA) networks, Frequency Division Multiple Access (FDMA) networks, Orthogonal FDMA (OFDMA) networks, Single-Carrier FDMA (SC-FDMA) networks, etc. The terms "networks" and "systems" are often used interchangeably. A CDMA network may implement a radio technology such as Universal Terrestrial Radio Access (UTRA), CDMA2000, etc. UTRA includes Wideband-CDMA (W-CDMA) and Low Chip Rate (LCR). CDMA2000 covers IS-2000, IS-95 and IS-856 standards.

A TDMA network may implement a radio technology such as Global System for Mobile Communications (GSM). An OFDMA network may implement a radio technology such as Evolved UTRA (E-UTRA), IEEE 802.11, IEEE 802.16, IEEE 802.20, Flash-OFDM®, etc. UTRA, E-UTRA, and GSM are part of Universal Mobile Telecommunication System (UMTS). Long Term Evolution (LTE) is an upcoming release of UMTS that uses E-UTRA. UTRA, E-UTRA, GSM, UMTS and LTE are described in documents from an organization named "3rd Generation Partnership Project" (3GPP). CDMA2000 is described in documents from an organization named "3rd Generation Partnership Project 2" (3GPP2). These various radio technologies and standards are known in the art. For clarity, certain aspects of the techniques are described below for LTE, and LTE terminology is used in much of the description below.

Single carrier frequency division multiple access (SC-FDMA) utilizes single carrier modulation and frequency domain equalization. SC-FDMA has similar performance and essentially the same overall complexity as those of OFDMA system. SC-FDMA signal has lower peak-to-average power ratio (PAPR) because of its inherent single carrier structure. SC-FDMA has drawn great attention, especially in the uplink communications where lower PAPR greatly benefits the mobile terminal in terms of transmit power efficiency. It is currently a working assumption for uplink multiple access scheme in 3GPP Long Term Evolution (LTE), or Evolved UTRA.

Figure 1:
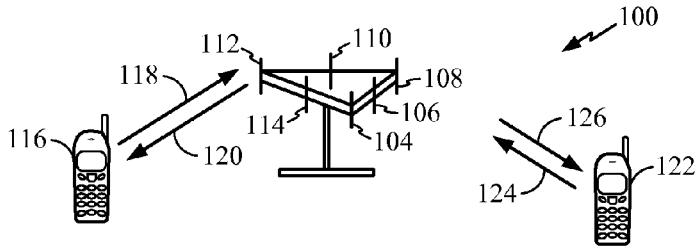
FIG. 1 illustrates a multiple access wireless communication system, in accordance with certain aspects of the present disclosure.

Referring to FIG. 1, a multiple access wireless communication system according to one embodiment is illustrated. An access point 100 (AP) includes multiple antenna groups, one including 104 and 106, another including 108 and 110, and an additional including 112 and 114. In FIG. 1, only two antennas are shown for each antenna group, however, more or fewer antennas may be utilized for each antenna group. Access terminal 116 (AT) is in communication with antennas 112 and 114, where antennas 112 and 114 transmit information to access terminal 116 over forward link 120 and receive information from access terminal 116 over reverse link 118. Access terminal 122 is in communication with antennas 106 and 108, where antennas 106 and 108 transmit information to access terminal 122 over forward link 126 and receive information from access terminal 122 over reverse link 124. In an FDD system, communication links 118, 120, 124 and 126 may use different frequencies for communication. For example, forward link 120 may use a different frequency than that used by reverse link 118.

Each group of antennas and/or the area in which they are designed to communicate is often referred to as a sector of the access point. In one embodiment, antenna groups each are designed to communicate to access terminals in a sector, of the areas covered by access point 100.

In communication over forward links 120 and 126, the transmitting antennas of access point 100 utilize beamforming in order to improve the signal-to-noise ratio of forward links for the different access terminals 116 and 122. Also, an access point using beamforming to transmit to access terminals scattered randomly through its coverage causes less interference to access terminals in neighboring cells than an access point transmitting through a single antenna to all its access terminals.

An access point may be a fixed station used for communicating with the terminals and may also be referred to as a Node B, or some other terminology. An access terminal may also be called an access terminal, user equipment (UE), a wireless communication device, terminal, access terminal or some other terminology.

Figure 2:
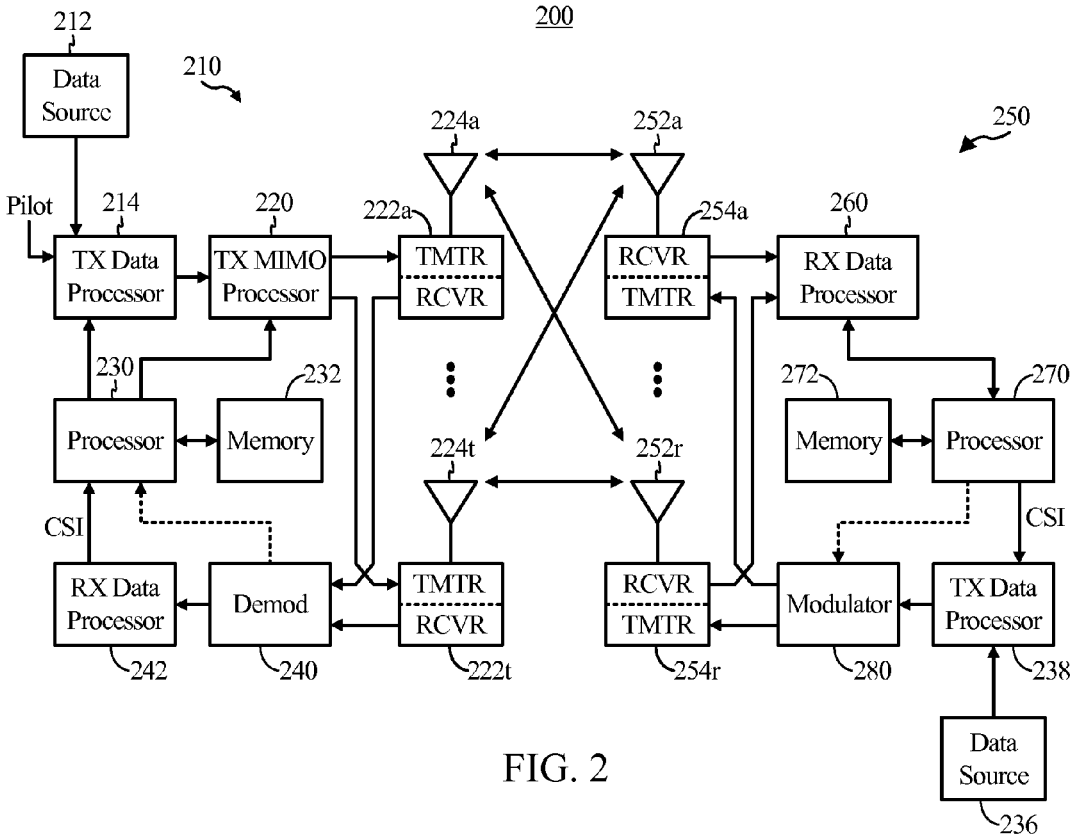
FIG. 2 illustrates a block diagram of a communication system, in accordance with certain aspects of the present disclosure.

FIG. 2 is a block diagram of an embodiment of a transmitter system 210 (also known as the access point) and a receiver system 250 (also known as access terminal) in a MIMO system 200. At the transmitter system 210, traffic data for a number of data streams is provided from a data source 212 to a transmit (TX) data processor 214.

A MIMO system employs multiple ($N_T$) transmit antennas and multiple ($N_R$) receive antennas for data transmission. A MIMO channel formed by the $N_T$ transmit and $N_R$ receive antennas may be decomposed into $N_S$ independent channels, which are also referred to as spatial channels, where $N_S \leqq \min\{N_T, N_R\}$. Each of the $N_S$ independent channels corresponds to a dimension. The MIMO system can provide improved performance (e.g., higher throughput and/or greater reliability) if the additional dimensionalities created by the multiple transmit and receive antennas are utilized.

A MIMO system may support a time division duplex (TDD) or a frequency division duplex (FDD) system. In a TDD system, the forward and reverse link transmissions are on the same frequency region so that the reciprocity principle allows the estimation of the forward link channel from the reverse link channel. This enables the access point to extract transmit beamforming gain on the forward link when multiple antennas are available at the access point.

In an embodiment, each data stream is transmitted over a respective transmit antenna. TX data processor 214 formats, codes, and interleaves the traffic data for each data stream based on a particular coding scheme selected for that data stream to provide coded data.

The coded data for each data stream may be multiplexed with pilot data using OFDM techniques. The pilot data is typically a known data pattern that is processed in a known manner and may be used at the receiver system to estimate the channel response. The multiplexed pilot and coded data for each data stream is then modulated (i.e., symbol mapped) based on a particular modulation scheme (e.g., binary phase shift keying (BPSK), quadrature phase shift keying (QPSK), M-PSK, or quadrature amplitude modulation (M-QAM)) selected for that data stream to provide modulation symbols. The data rate, coding, and modulation for each data stream may be determined by instructions performed by processor 230.

The modulation symbols for all data streams are then provided to a TX MIMO processor 220, which may further process the modulation symbols (e.g., for OFDM). TX MIMO processor 220 then provides $N_T$ modulation symbol streams to $N_T$ transmitters (TMTR) 222*a* through 222*t*. In certain embodiments, TX MIMO processor 220 applies beamforming weights to the symbols of the data streams and to the antenna from which the symbol is being transmitted.

Each transmitter 222 receives and processes a respective symbol stream to provide one or more analog signals, and further conditions (e.g., amplifies, filters, and upconverts) the analog signals to provide a modulated signal suitable for transmission over the MIMO channel. $N_T$ modulated signals from transmitters 222*a* through 222*t* are then transmitted from $N_T$ antennas 224*a* through 224*t*, respectively.

At receiver system 250, the transmitted modulated signals are received by $N_R$ antennas 252*a* through 252*r* and the received signal from each antenna 252 is provided to a respective receiver (RCVR) 254*a* through 254*r*. Each receiver 254 conditions (e.g., filters, amplifies, and downconverts) a respective received signal, digitizes the conditioned signal to provide samples, and further processes the samples to provide a corresponding "received" symbol stream.

An RX data processor 260 then receives and processes the $N_R$ received symbol streams from $N_R$ receivers 254 based on a particular receiver processing technique to provide $N_T$ "detected" symbol streams. The RX data processor 260 then demodulates, deinterleaves, and decodes each detected symbol stream to recover the traffic data for the data stream. The processing by RX data processor 260 is complementary to that performed by TX MIMO processor 220 and TX data processor 214 at transmitter system 210. Processor 270 formulates a reverse link message comprising a matrix index portion and a rank value portion.

The reverse link message may comprise various types of information regarding the communication link and/or the received data stream. The reverse link message is then processed by a TX data processor 238, which also receives traffic data for a number of data streams from a data source 236, modulated by a modulator 280, conditioned by transmitters 254*a* through 254*r*, and transmitted back to transmitter system 210.

At transmitter system 210, the modulated signals from receiver system 250 are received by antennas 224, conditioned by receivers 222, demodulated by a demodulator 240, and processed by a RX data processor 242 to extract the reserve link message transmitted by the receiver system 250. Processor 230 calculates the beamforming weights and processes the extracted message.

The channels between an access point and user equipments are classified into Control Channels and Traffic Channels. The Control Channels comprise Broadcast Control Channel (BCCH) which is a DL channel for broadcasting system control information, Paging Control Channel (PCCH) which is a DL channel that transfers paging information, Multicast Control Channel (MCCH) which is a Point-to-multipoint DL channel used for transmitting Multimedia Broadcast and Multicast Service (MBMS) scheduling and control information for one or several MTCHs.

Figure 3:
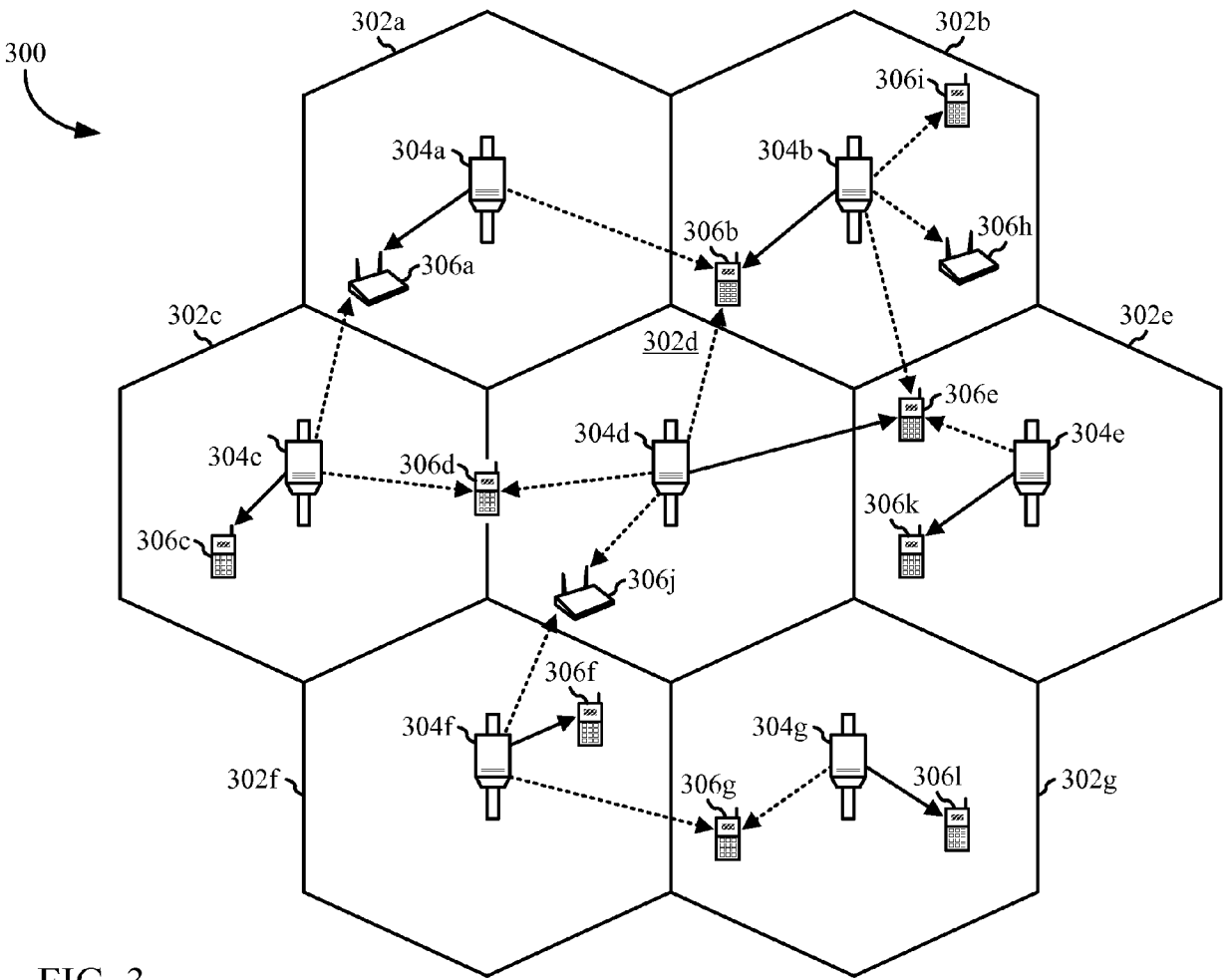
FIG. 3 illustrates an exemplary wireless communication system configured to support a number of users, in which various disclosed embodiments and aspects may be implemented.

FIG. 3 illustrates an exemplary wireless communication system 300 configured to support a number of users, in which various disclosed embodiments and aspects may be implemented. As shown in FIG. 3, by way of example, system 300 provides communication for multiple cells 302, such as, for example, macro cells 302*a*-302*g*, with each cell being serviced by a corresponding access point (AP) 304 (such as APs 304*a*-304*g*). Each cell may be further divided into one or more sectors. Various user equipments (UEs) 306, including UEs 306*a*-306*l*, also known interchangeably as access terminals (ATs) or mobile stations, are dispersed throughout the system. Each UE 306 may communicate with one or more APs 304 on a forward link (FL) and/or a reverse link (RL) at a given moment, depending upon whether the UE is active and whether it is in soft handoff, for example. The wireless communication system 300 can provide service over a large geographic region, for example, macro cells 302*a*-302*g* can cover a plurality of blocks in a neighborhood.

Certain aspects of the present disclosure propose techniques for paging and notification over a cellular network in an emergency situation. In some wireless standards such as LTE, an Earthquake and Tsunami Warning System (ETWS) is developed. In the LTE standard, the warning notification is delivered over the system information broadcast. However, the normal system information block (SIB) transmission and its modifications are restricted by a 'modification period.' For urgent emergency warning messages, the system should not waste any time and the modification period may be too long depending on the nature of the emergency situation.

In accordance with an aspect, the broadcast control channel (BCCH) may be utilized for delivery of ETWS notifications. Disclosed herein are techniques for transmission of a primary notification, paging for ETWS, and scheduling of ETWS SIB messages. It should be noted, however, while the present disclosure describes EWTS as a particular example, those skilled in the art will recognize that the techniques presented herein may be applied to transmit any type of emergency information.

For certain aspects of the present disclosure, ETWS-specific Information Elements (IEs) may be used for transmitting primary notification of an emergency situation. This method ensures fast delivery of the primary notification. However, ETWS-specific IEs may be subject to message size restrictions. Considering the amount of information that needs to be transmitted during the notification of an emergency situation (e.g., security information), the limitation on the message size may not be desirable.

For certain aspects of the present disclosure, ETWS-specific SIB messages may be used for transmitting primary notification of an emergency situation. By utilizing ETWS-specific SIB messages, the system is able to bypass the restrictions on the message size because the broadcast control channel is able to service SIB messages with large sizes by employing soft combining techniques. However, one of the drawbacks of the ETWS-specific SIB transmission method is the latency of the system due to the nature of SIB scheduling, which is restricted by a 'modification period'.

In another aspect of the present disclosure, the ETWS SIB messages may be scheduled without restriction by a modification period. In addition, the broadcast control channel (BCCH) may be used for the delivery of the primary notification. "No-delay" scheduling of ETWS SIB messages is discussed in further detail below.

In accordance with an aspect, ETWS paging may be provided based on a paging mechanism associated with a cellular network. However, achievable maximum size of paging message is limited due to the 'broadcast' nature of the paging in cellular networks. In addition, introducing new code points allocated for emergency paging may become expensive due to future extendibility. In LTE systems, paging of users are performed by indicating identities of the specific users in the paging message, such as S-TMSI (Temporary Mobile Subscriber Identity) or IMSI (International Mobile Subscriber Identity). For an aspect, a special IMSI message may be used for emergency notifications.

Scheduling and transmission of ETWS SIB messages may be subject to one or more of the following requirements: i) The scheduling of ETWS SIB messages should be known to the UE prior to ETWS paging, so that the user can immediately start receiving the ETWS SIB messages following an emergency notification. Therefore, after receiving ETWS paging, the UE should not spend any time to read scheduling information that is included in SIB1. ii) Activation of ETWS SIB transmission should not be restricted by a modification period. iii) Preservation or preemption of resources for the use of ETWS SIB messages should be possible. iv) Notification of an emergency situation should be provided to all the UEs, even the UEs that have just entered a cell but have not started receiving paging messages.

For certain aspects of the present disclosure, an emergency notification system may be designed with the following characteristics to satisfy all of the above requirements. First, the scheduling information for ETWS SIB messages may always be present in the scheduling information in SIB1, regardless of whether the ETWS SIB messages are transmitted or not. Therefore, the UE will be ready to receive ETWS SIB messages immediately after receiving the notification of the emergency situation. Thus, the UE may not waste any time on reading the scheduling information for ETWS SIB messages after being notified of the emergency situation.

Second, the UE may start ETWS SIB message reception immediately after it is informed of the transmission of an emergency message, without waiting for the next modification period boundary, therefore, avoiding any delays. Third, the scheduling (e.g., transmission window) of non-ETWS SIB messages and ETWS SIB messages may overlap in order to facilitate the preemption of the resources.

Fourth, the scheduling of ETWS SIB messages may override the scheduling of non-ETWS SIB messages during the ETWS transmission mode to give priority to the ETWS SIB messages. Fifth, a flag in SIB1 may be employed to indicate whether the cell is in ETWS SIB transmission mode or not. The flag in SIB1 is also used to notify the UE of the emergency situation.

Figure 4:
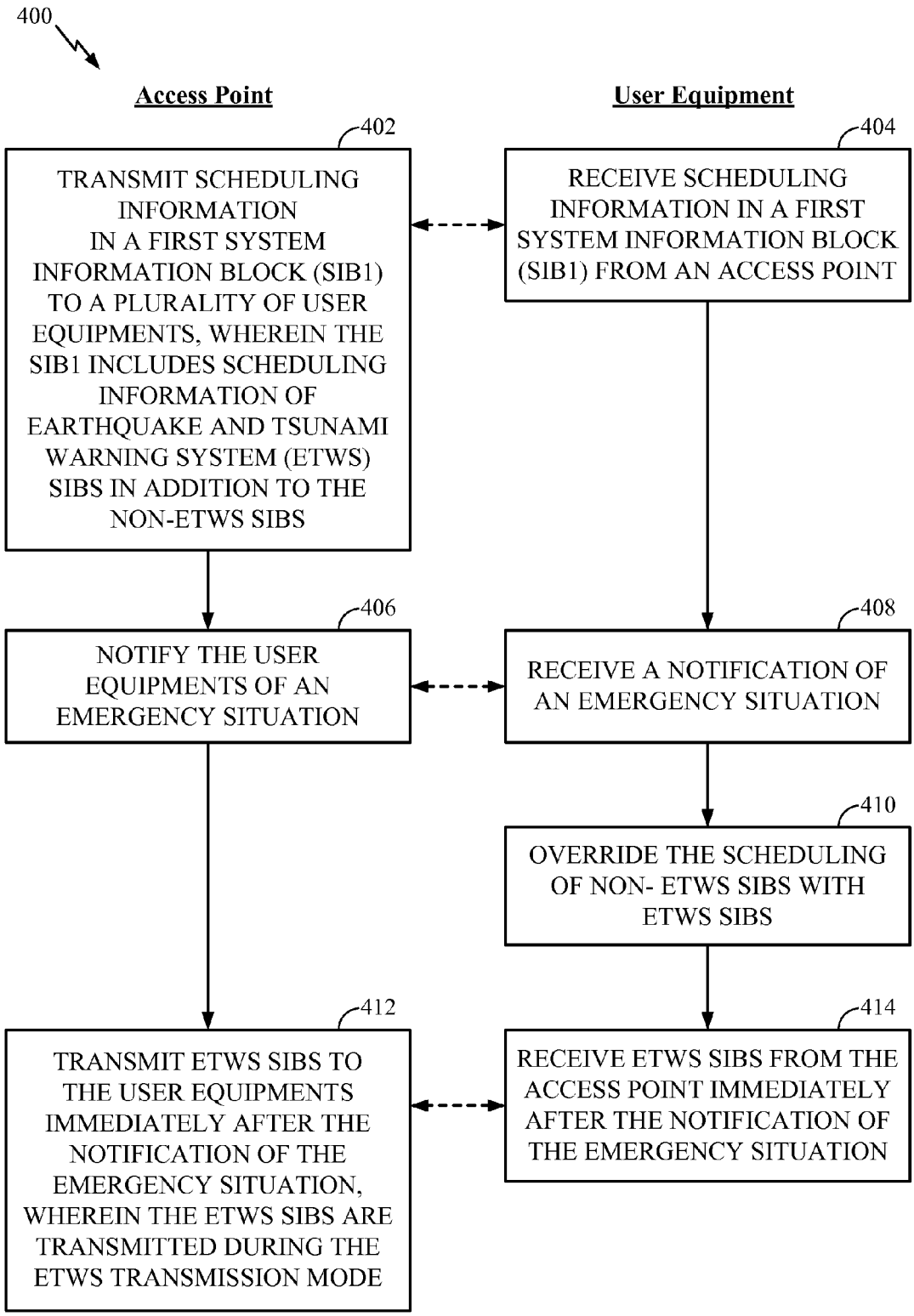
FIG. 4 illustrates example operations for an emergency warning notification mechanism over cellular network, in accordance with certain aspects of the present disclosure.

FIG. 4 illustrates example operations for an emergency warning notification mechanism over cellular network, in accordance with certain aspects of the present disclosure. At 402, an access point transmits scheduling information in a system information block (SIB1) to a plurality of user equipments, wherein the SIB1 includes scheduling information of ETWS SIB messages in addition to the non-ETWS SIB messages. At 404, a UE receives scheduling information in SIB1 from the access point. At 406, the access point notifies the UEs of an emergency situation. At 408, the UE receives a notification of an emergency situation. At 410, the UE overrides the scheduling of non-ETWS SIB messages with ETWS SIB messages. At 412, the access point enters ETWS transmission mode and transmits ETWS SIB messages to the UEs immediately after the notification of the emergency situation. At 414, the UE starts receiving ETWS SIB messages from the access point immediately after the notification.

Figure 5:
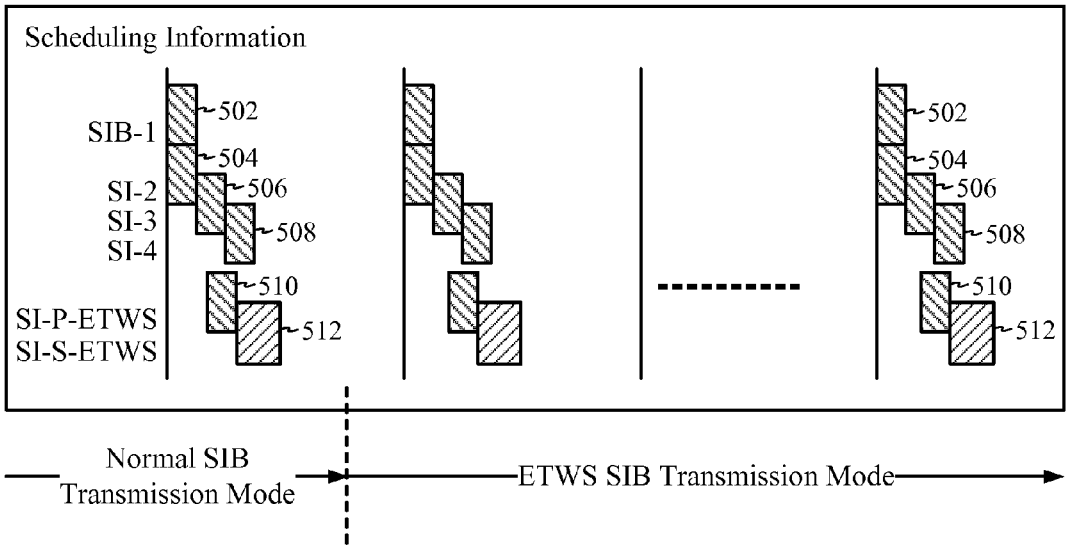
FIG. 5 illustrates an example of ETWS-SIB (Earthquake and Tsunami Warning System-System Information Block) message scheduling, in accordance with certain aspects of the present disclosure.

FIG. 5 illustrates an example of ETWS SIB scheduling, in accordance with certain aspects of the present disclosure. The first system information block, SIB1 502, includes the scheduling information for ETWS SIB messages (i.e., SI-P-ETWS 510 and SI-S-ETWS 512) in addition to the non-ETWS or normal SIB messages (i.e., SI-2 504, SI-3 506 and SI-4 508). The scheduling of ETWS SIB messages SI-P-ETWS 510 and SI-S-ETWS 512 may overlap with the scheduling of some of the non-ETWS SIB messages SI-3 506, SI-4 508. The overlap may not cause any problems because at any point in time only one set of SIB messages are used (i.e., either ETWS SIB messages or non-ETWS SIB messages). The scheduling information may remain constant for at least some part of the normal SIB transmission mode and ETWS SIB transmission mode.

Figure 6:
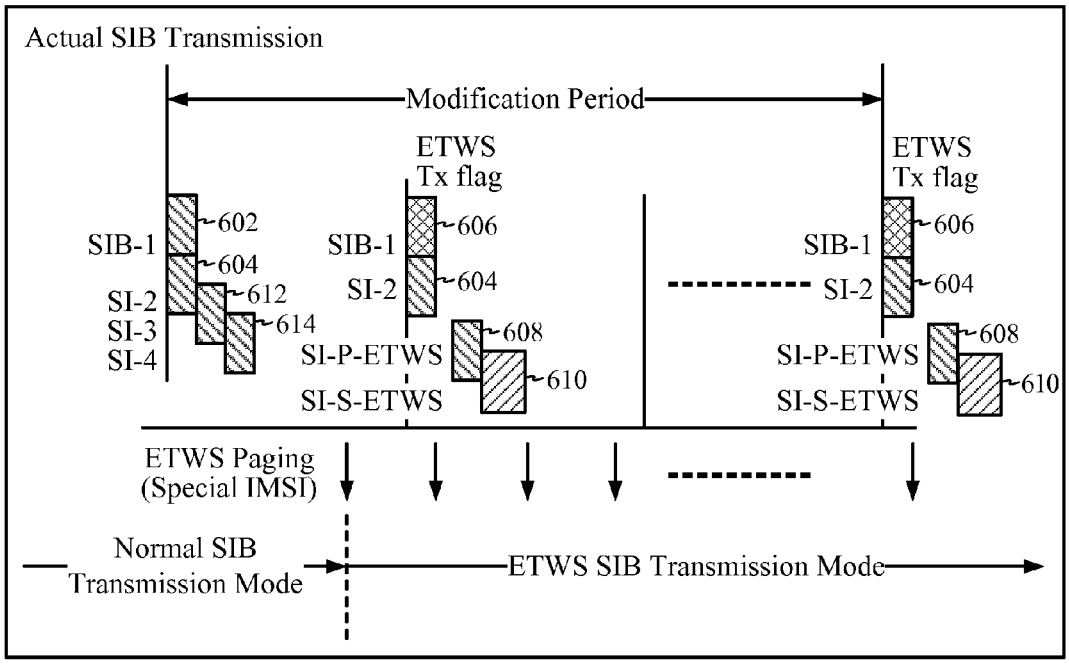
FIG. 6 illustrates an example of ETWS-SIB message transmission, in accordance with certain aspects of the present disclosure.

FIG. 6 illustrates an example of ETWS SIB transmission in emergency situations, in accordance with certain aspects of the present disclosure. During the normal SIB transmission mode, the SIB1 602 containing the scheduling information of the ETWS SIB messages and non-ETWS SIB messages is transmitted to all the stations. Following the SIB1 message, the normal SIB messages SI-2 604, SI-3 612 and SI-4 614 are transmitted by the AP. When an emergency situation occurs, the AP changes a flag in the SIB1 message 606 to notify the UE of the emergency situation. Immediately following the notification, the AP starts to transmit the ETWS SIB messages SI-P-ETWS 608 and SI-S-ETWS 610. After all the emergency information is transmitted to the user equipments, the AP may revert to the normal operation mode and continue transmitting the normal SIB messages.

In accordance with an aspect, a user may encounter a transition from a normal transmission mode to an ETWS transmission mode during the course of a SIB acquisition. In LTE systems, the dynamic transmission of SIBs over physical downlink shared channel (PDSCH) is indicated by a common SI-RNTI (System Information-Radio Network Temporary Identifier) on physical downlink control channel (PDCCH). If the scheduling information between a non-ETWS SIB and an ETWS SIB overlap, the user would not be able to detect the transmission of a ETWS SIB message unless it reads the scheduling information in SIB1 again. For certain aspects, complications associated with this case may be avoided by introducing a separate SI-RNTI to assign resources for ETWS SIB messages.

Figure 4A:
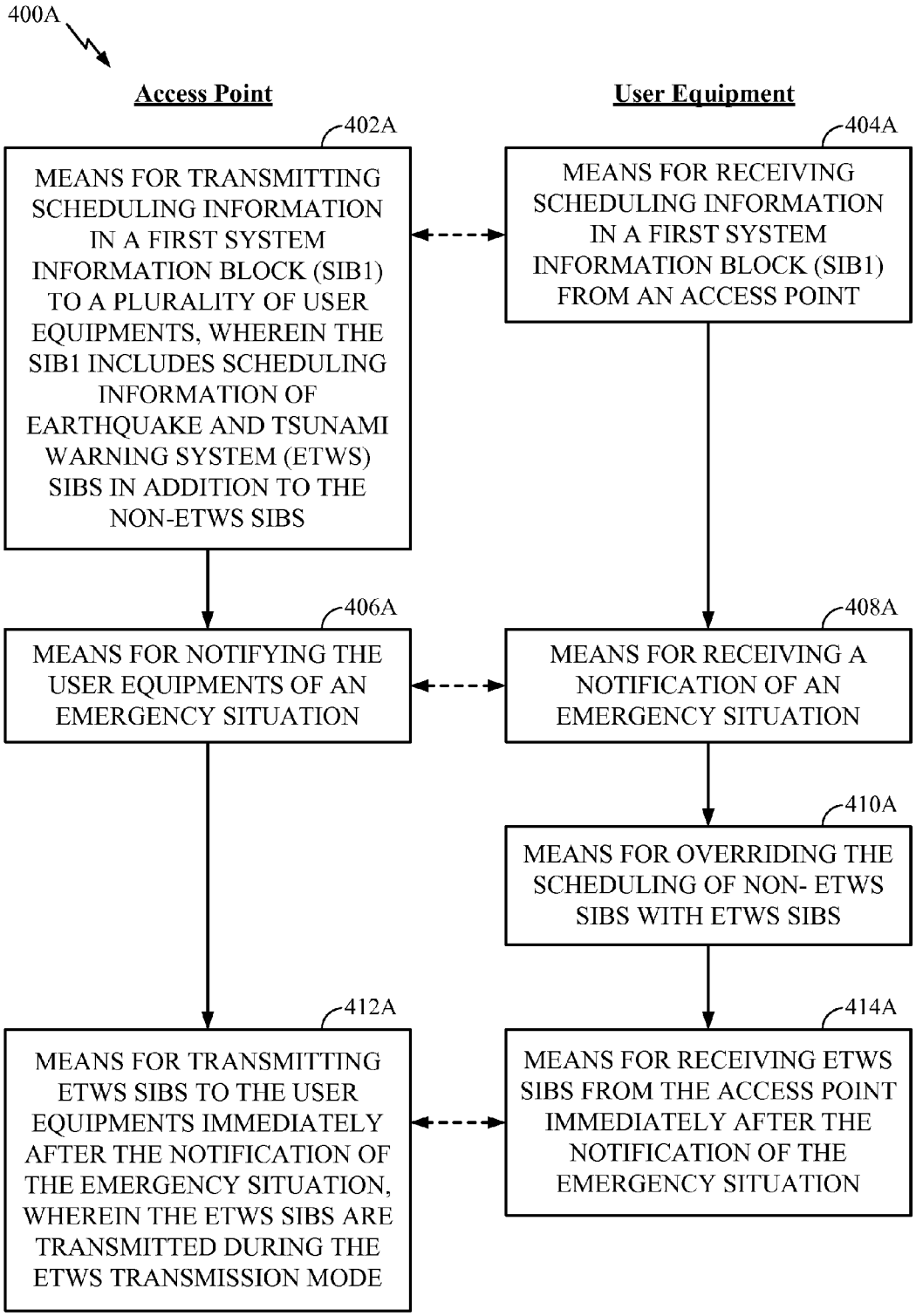
FIG. 4A illustrates example components capable of performing the operations illustrated in FIG. 4.

The various operations of methods described above may be performed by various hardware and/or software component (s) and/or module(s) corresponding to means-plus-function blocks illustrated in the Figures. For example, blocks 402-414 illustrated in FIG. 4 correspond to means-plus-function blocks 402A-414A illustrated in FIG. 4A. More generally, where there are methods illustrated in Figures having corresponding counterpart means-plus-function Figures, the operation blocks correspond to means-plus-function blocks with similar numbering.

The various illustrative logical blocks, modules and circuits described in connection with the present disclosure may be implemented or performed with a general purpose processor, a digital signal processor (DSP), an application specific integrated circuit (ASIC), a field programmable gate array signal (FPGA) or other programmable logic device (PLD), discrete gate or transistor logic, discrete hardware components or any combination thereof designed to perform the functions described herein. A general purpose processor may be a microprocessor, but in the alternative, the processor may be any commercially available processor, controller, microcontroller or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the present disclosure may be embodied directly in hardware, in a software module executed by a processor, or in a combination of the two. A software module may reside in any form of storage medium that is known in the art. Some examples of storage media that may be used include random access memory (RAM), read only memory (ROM), flash memory, EPROM memory, EEPROM memory, registers, a hard disk, a removable disk, a CD-ROM and so forth. A software module may comprise a single instruction, or many instructions, and may be distributed over several different code segments, among different programs, and across multiple storage media. A storage medium may be coupled to a processor such that the processor can read information from, and write information to, the storage medium. In the alternative, the storage medium may be integral to the processor.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

The functions described may be implemented in hardware, software, firmware or any combination thereof. If implemented in software, the functions may be stored as one or more instructions on a computer-readable medium. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, include compact disc (CD), laser disc, optical disc, digital versatile disc (DVD), floppy disk, and optical disc sold under the trademark BLU-RAY DISC® where disks usually reproduce data magnetically, while discs reproduce data optically with lasers.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

Further, it should be appreciated that modules and/or other appropriate means for performing the methods and techniques described herein can be downloaded and/or otherwise obtained by a user terminal and/or base station as applicable. For example, such a device can be coupled to a server to facilitate the transfer of means for performing the methods described herein. Alternatively, various methods described herein can be provided via storage means (e.g., RAM, ROM, a physical storage medium such as a compact disc (CD) or floppy disk, etc.), such that a user terminal and/or base station can obtain the various methods upon coupling or providing the storage means to the device. Moreover, any other suitable technique for providing the methods and techniques described herein to a device can be utilized.

It is to be understood that the claims are not limited to the precise configuration and components illustrated above. Various modifications, changes and variations may be made in the arrangement, operation and details of the methods and apparatus described above without departing from the scope of the claims.

While the foregoing is directed to embodiments of the present disclosure, other and further embodiments of the disclosure may be devised without departing from the basic scope thereof, and the scope thereof is determined by the claims that follow.

What is claimed is:

1. A method for wireless communications by an access point, comprising:

transmitting scheduling information in a first system information block (SIB1) to a plurality of user equipments, wherein the SIB1 includes scheduling information of emergency information and non-emergency information;

notifying the user equipments of an emergency situation; and transmitting emergency information to the user equipments to provide more information about the emergency situation.

2. The method of claim 1, wherein notifying the user equipments of an emergency situation comprises:

updating a flag in SIB1 to indicate the emergency information transmission mode.

3. The method of claim 1, wherein the emergency information comprises earthquake and tsunami warning system (ETWS) SIB messages and the non-emergency information comprises non-ETWS SIB messages, and the scheduling of ETWS SIB messages overrides the scheduling of the non-ETWS SIB messages during emergency information transmission mode.

4. The method of claim 1, wherein the transmission of emergency information to the user equipments starts immediately after the notification of the emergency situation.

5. The method of claim 1, further comprising:

transmitting a special SI-RNTI (System Information-Radio Network Temporary Identifier) to user equipments to assign resources for the emergency information.

6. A method for wireless communications by a user equipment, comprising:

receiving scheduling information in a first system information block (SIB1) from an access point, wherein the SIB1 includes scheduling information of emergency information and non-emergency information;

receiving a notification of an emergency situation;

overriding the scheduling of non-emergency information with emergency information; and receiving emergency information from the access point after the notification of the emergency situation.

7. The method of claim 6, further comprising:

receiving a special SI-RNTI (System Information-Radio Network Temporary Identifier) on a common control channel that assigns the resource for emergency information.

8. The method of claim 7, wherein the emergency information is detected based on the resource assignment conveyed by the special SI-RNTI message.

9. The method of claim 6, wherein the emergency information comprises earthquake and tsunami warning system (ETWS) SIB messages and the non-emergency information comprises non-ETWS SIB messages, and the reception of ETWS SIB messages from the access point starts immediately after the notification of the emergency situation.

10. An apparatus for wireless communications by an access point, comprising:

logic for transmitting scheduling information in a first system information block (SIB1) to a plurality of user equipments, wherein the SIB1 includes scheduling information of emergency information and non-emergency information;

logic for notifying the user equipments of an emergency situation; and logic for transmitting emergency information to the user equipments to provide more information about the emergency situation.

11. The apparatus of claim 10, wherein notifying the user equipments of an emergency situation comprises:

logic for updating a flag in SIB1 to indicate the ETWS SIB transmission mode.

12. The apparatus of claim 10, wherein the emergency information comprises earthquake and tsunami warning system (ETWS) SIB messages and the non-emergency information comprises non-ETWS SIB messages, and the scheduling of ETWS SIB messages overrides the scheduling of the non-ETWS SIB messages during Emergency information transmission mode.

13. The apparatus of claim 10, wherein the transmission of emergency information to the user equipments starts immediately after the notification of the emergency situation.

14. The apparatus of claim 10, further comprising:

logic for transmitting a special SI-RNTI (System Information-Radio Network Temporary Identifier) to user equipments to assign resources for the emergency information.

15. An apparatus for wireless communications by a user equipment, comprising:

logic for receiving scheduling information in a first system information block (SIB1) from an access point, wherein the SIB1 includes scheduling information of emergency information and non-emergency information;

logic for receiving a notification of an emergency situation;

logic for overriding the scheduling of non-emergency information with emergency information; and logic for receiving emergency information from the access point after the notification of the emergency situation.

16. The apparatus of claim 15, further comprising:

logic for receiving a special SI-RNTI (System Information-Radio Network Temporary Identifier) on a common control channel that assigns the resource for emergency information.

17. The apparatus of claim 16, wherein the emergency information is detected based on the resource assignment conveyed by the special SI-RNTI message.

18. The apparatus of claim 15, wherein emergency information comprises earthquake and tsunami warning system (ETWS) SIB messages and the non-emergency information comprises non-ETWS SIB messages, and the reception of ETWS SIB messages from the access point starts immediately after the notification of the emergency situation.

19. An apparatus for wireless communications by an access point, comprising:

means for transmitting scheduling information in a first system information block (SIB1) to a plurality of user equipments, wherein the SIB1 includes scheduling information of emergency information and non-emergency information;

means for notifying the user equipments of an emergency situation; and means for transmitting emergency information to the user equipments to provide more information about the emergency situation.

20. An apparatus for wireless communications by a user equipment, comprising:

means for receiving scheduling information in a first system information block (SIB1) from an access point, wherein the SIB1 includes scheduling information of emergency information and non-emergency information;

means for receiving a notification of an emergency situation;

means for overriding the scheduling of non-emergency information with emergency information; and means for receiving emergency information from the access point after the notification of the emergency situation.

21. A computer-program product for wireless communications by an access point, comprising a computer-readable medium having instructions stored thereon, the instructions being executable by one or more processors and the instructions comprising:

instructions for transmitting scheduling information in a first system information block (SIB1) to a plurality of user equipments, wherein the SIB1 includes scheduling information of emergency information and non-emergency information;

instructions for notifying the user equipments of an emergency situation; and instructions for transmitting emergency information to the user equipments to provide more information about the emergency situation.

22. A computer-program product for wireless communications by a user equipment, comprising a computer-readable medium having instructions stored thereon, the instructions being executable by one or more processors and the instructions comprising:

instructions for receiving scheduling information in a first system information block (SIB1) from an access point, wherein the SIB1 includes scheduling information of emergency information and non-emergency information;

instructions for receiving a notification of an emergency situation;

instructions for overriding the scheduling of non-emergency information with emergency information; and instructions for receiving emergency information from the access point after the notification of the emergency situation.

23. An apparatus for wireless communications by an access point, comprising:

at least one processor configured to:

transmit scheduling information in a first system information block (SIB1) to a plurality of user equipments, wherein the SIB1 includes scheduling information of emergency information and non-emergency information;

notify the user equipments of an emergency situation, and transmit emergency information to the user equipments to provide more information about the emergency situation, wherein the emergency information are transmitted during the emergency information transmission mode; and a memory coupled to the processor.

24. An apparatus for wireless communications by a user equipment, comprising:

at least one processor configured to:

receive scheduling information in a first system information block (SIB1) from an access point, wherein the SIB1 includes scheduling information of emergency information and non-emergency information;

receive a notification of an emergency situation;

override the scheduling of non-emergency information with emergency information, and receive emergency information from the access point after the notification of the emergency situation; and a memory coupled to the processor.

* * * * *